US005083755A

United States Patent [19]

Nenkov et al.

[11] Patent Number: 5,083,755

[45] Date of Patent: Jan. 28, 1992

[54] FACE SHOCK ABSORBER FOR EXTRACTING CORE-COLLECTING PIPES

[75] Inventors: Nikolay D. Nenkov; Dimo S. Yordanov; Peter V. Nedyalkov, all of Sofia, Bulgaria; Evgeni D. Hromin, Moscow, U.S.S.R.

[73] Assignee: Geologoprouchvatelno Predpriatie, Sofia, Bulgaria

[21] Appl. No.: 460,775

[22] Filed: Jan. 4, 1990

[51] Int. Cl.[5] ..... F16F 1/34

[52] U.S. Cl. ..... 267/135; 175/321; 267/137; 285/140; 464/20; 464/169

[58] Field of Search ..... 267/125, 134, 135, 137; 175/321; 464/20, 21, 169; 285/140, 302

[56] References Cited

U.S. PATENT DOCUMENTS

| | | | |
|---|---|---|---|
| 3,254,508 | 6/1966 | Garrett | 175/321 |
| 4,494,615 | 1/1985 | Jones | 175/321 X |
| 4,765,418 | 8/1988 | Ennis | 175/321 X |
| 4,776,436 | 10/1988 | Nenkov et al. | 138/268 |

FOREIGN PATENT DOCUMENTS 2093188 8/1982 United Kingdom .

*Primary Examiner*—George E. A. Halvosa
*Attorney, Agent, or Firm*—Klein & Vibber

[57] ABSTRACT

Face shock absorber for extracting core-collecting pipes used for the drilling of solid mineral resources, which is incorporated in the drilling unit above the rock-breaking tool. It comprises a housing, the opposite ends of which are connected to a top and a bottom adapter, respectively. The top adapter is threadably connected to the top of the housing, the bottom end of which is provided with face fingers which interdigitate with the face fingers of the bottom adapter, formed in its top end. The bottom adapter is connected via an internal thread in the bottom end to a rock breaking tool inside the housing there are disposed external spring rings and internal spring rings which form a cylindrical spring pack, the top end of which is in contact with the top adapter, while its bottom end is in contact with the top face of a spacing sleeve, which is seated on the top face of a carrying collar forming part of the bottom adapter. The bottom surface of the carrying collar is in contact with the top surface of a supporting collar of an arrester sleeve, which is threadably connected at its top end by means of an internal thread to the bottom end of the top adapter.

2 Claims, 1 Drawing Sheet

FACE SHOCK ABSORBER FOR EXTRACTING CORE-COLLECTING PIPES

BACKGROUND OF THE INVENTION

This invention relates to a face shock absorber for extracting core-collecting pipes, used for the drilling of solid mineral resources, Which is incorporated in the drilling unit above the rock-breaking tool.

A known shock absorber (1) consists of a top adapter of cylindrical shape, in both ends of which there are machined internal threads. It is connected by a means of the bottom thread to a spindle. The external surface of the top adapter is stepped and in the lowest step there are disposed keys in longitudinal slots. The keys are disposed in seats machined in a two-stepped nut, which embraces the bottom step of the top adapter and is connected by means of a thread to the housing. Between the internal wall of the housing and the spindle there is disposed freely a top ring which supports the bottom end of the top adapter. The inner space formed between the housing, the top ring, the spindle and the bottom ring forms a working chamber. It is divided by intermediate sleeves in separate sections, and in each of the sections there is disposed a spherical head of the spindle. All sections are filled with active elements-balls. The bottom ring, which is the movable bottom of the working chamber, is seated on concentrically arranged one-inside-the-other slotted springs of different lengths. The latter are seated on a ring-shaped nut, underneath which there is disposed the bottom adapter, and both components are connected to the housing by means of a thread.

The drawbacks of this type of face shock absorbers lie in their small internal diameters which result in disturbing the uniform drive of the drill rod, their great lengths and their intricate designs.

SUMMARY OF THE INVENTION

It is therefore a general object of this invention to develop a face shock absorber for extracting core-collecting pipes which can reduce in a wide range the longitudinal vibrations; does not require a change of the external and the internal diameters of the drill rod; and is distinguished by a simplified design.

This object is achieved by a face shock absorber for extracting core-collecting pipes which comprises a housing, both ends of which are connected to a top and a bottom adapter, respectively. According to the invention, the top adapter is connected to the bottom external thread of the housing, the bottom end of which is provided with face fingers, engaged with the face fingers of the bottom adapter, formed in its top end. The bottom adapter is provided with an internal thread in the bottom end, and inside the housing there are disposed external spring rings and internal spring rings, which form a spring pack, the top end of which is in contact with the top adapter, while its bottom end is in touch with the face top surface of a spacing sleeve which is seated on the top face surface of the internal carrying step of the bottom adapter. The bottom surface of the carrying step is in contact with the supporting step of an arrester sleeve, which is connected by means of an internal thread to the bottom end of the top adapter.

The advantage of the invention lies in that the disclosed face shock absorber provides conditions for an effective damping of the longitudinal vibrations; the possibility for incorporation above the rock-breaking tool, does not require a change of the internal and the external diameters of the drill rod.

BRIEF DESCRIPTION OF DRAWINGS

For a better understanding of the invention, reference should be made to the accompanying drawing in which there is illustrated and described a preferred embodiment of the invention.

The single FIGURE of the drawing is a longitudinal view, partially in cross-section of a face shock absorber according to the invention.

DETAILED DESCRIPTION

Figure 1:
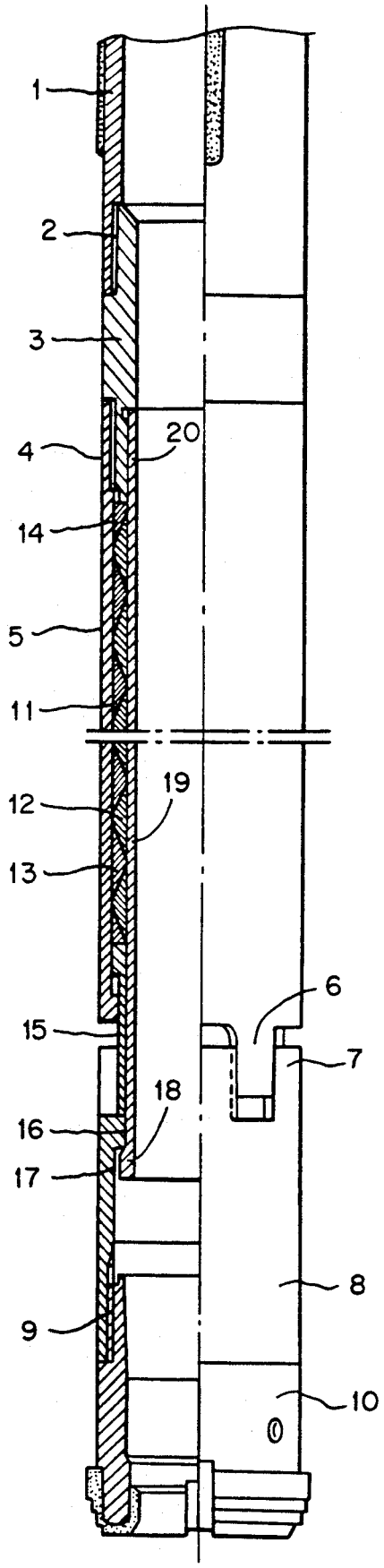

The face shock absorber consists of a top adapter 3, the top end of which is provided with an external thread 2 and is connected to the drill rod 1, while by means of the bottom external thread 4 it is connected to the housing 5, which is a cylindrical body with a thicker lower free end. In this lower end there interdigitate face fingers 6 of the housing 5 with the face fingers 7 formed in the top end of the bottom adapter 8 with which they are continuously in engagement. This bottom adapter 8 is formed as a cylindrical body with smooth external surface and stepped internal surface; in the central portion of this adapter 8 there is provided a carrying collar 16 and in its bottom end there is machined an internal thread 9, by means of which it is connected to the rock-breaking tool 10.

Inside the housing 5 there are provided external spring rings 11 and internal rings 12, which form a pack 13. The external spring rings 11 have a cylindrical external surface and a conical internal surface, while the internal rings 12 have an oppositely disposed surface, i.e. the external surface is matingly conical while the internal surface is cylindrical.

The top end of the spring pack 13 is in contact with the face 14 of the top adapter 3, while it is seated with its bottom end on the spacing sleeve 15, which is of cylindrical shape with a support collar in its top end. The spacing sleeve 15 is seated on the internal carrying step 16 of the bottom adapter 8, which by means of its bottom surface 17 is in contact with the supporting collar 18 of the cylindrical arrester sleeve 19; the latter is disposed inside the spring pack 13 and is connected by means of the internal thread 20 to the top adapter 3. There is formed a gap between the internal and the external surfaces of the spring pack 13 and the respective surfaces of the housing 5 and the arrester sleeve 19.

The face shock absorber transmits, during operation, the axial force from the drill rod 1 via the top adapter 3, the spring pack 13 and the bottom adapter 8 to the rock-breaking tool 10, and the torque is transmitted from the drill rod 1 via the adapter 3, the housing 5 the face fingers 6, and the face fingers 7 to the rock-breaking tool 10. The forces produced during the breaking loose of the core are taken up by the arrester sleeve 19.

The reduction of the longitudinal vibrations during drilling is achieved as a result of the radial deformation occurring in the external spring rings 11 and the internal spring rings 12, as well as of the friction produced between their contact surfaces when loaded.

While a specific embodiment of the invention has been shown and described in detail to illustrate the application of the principles of the invention, it will be understood that the invention may be embodied otherwise without departing from such principles.

References cited;

1. Bulgarian Author's Certificate No. 44 976.

What we claim is:

1. A face shock absorber for extracting core-collecting pipes which comprise in combination a cylindrical housing, said housing having a top end and a bottom end, both ends of which are respectively connected to a top adapter, and a bottom adapter;

said top adapter having a top end and a bottom end and a bottom face;

said bottom adapter having a top end and a bottom end and an annular support portion with a top surface face and a bottom surface;

the bottom end of said top adapter is connected to said housing;

the bottom end of said housing is provided with a plurality of face fingers which interdigitate with a corresponding plurality of face fingers formed in the top end of said bottom adapter, the bottom end of said bottom adapter is provided with an internal thread and is threadably connected to a rock breaking tool, there are disposed inside the housing a plurality of external spring rings and a plurality of internal spring rings which jointly form spring pack means, and said spring pack means having a top end and a bottom end;

said spring pack means is in contact with its top end with the bottom face of the top adapter;

a spacing sleeve having a top surface face;

the bottom end of said spring pack means is seated on the top surface face of said spacing sleeve;

said spacing sleeve seated on the top surface face of said annular support portion of said bottom adapter;

an arrester sleeve connected to the bottom end of said top adapter, said arrester sleeve having a bottom supporting collar;

said bottom surface of said annular support portion of said bottom adapter being in contact with said bottom supporting collar of said arrester sleeve;

wherein internal and external diameters of the elements forming the face shock absorber are essentially the same as elements forming a cooperating drilling column; and whereby it is possible to incorporate such a face shock absorber into a thin-walled drill rod string, a rock breaking tool and a reamer above it are relatively insulated from the longitudinal vibrations to which the drilling rod itself is subjected; the stress distribution of the various components forming the face shock absorber is much more favorable, and stress concentrations are preponderantly avoided; the spring elements forming the spring pack means are protected from soiling.

2. The face shock absorber for extracting core-collecting pipes as set forth in claim 1, wherein said top adapter is threadably connected to said housing and said arrester sleeve is threadably connected to the bottom end of said top adapter.

* * * * *